US008199950B2

(12) United States Patent
Petef et al.

(10) Patent No.: US 8,199,950 B2
(45) Date of Patent: Jun. 12, 2012

(54) EARPHONE AND A METHOD FOR PROVIDING AN IMPROVED SOUND EXPERIENCE

(75) Inventors: Andrej Petef, Lund (SE); Gunnar Klinghult, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 1268 days.

(21) Appl. No.: 11/876,071

(22) Filed: Oct. 22, 2007

(65) Prior Publication Data

US 2009/0103763 A1 Apr. 23, 2009

(51) Int. Cl.
*H04R 25/00* (2006.01)

(52) U.S. Cl. ..... 381/322; 381/328; 381/329

(58) Field of Classification Search ..... 381/322, 381/328, 329

See application file for complete search history.

(56) References Cited

U.S. PATENT DOCUMENTS

| | | | | |
|---|---|---|---|---|
| 4,133,984 | A * | 1/1979 | Akiyama | 381/328 |
| 4,539,440 | A * | 9/1985 | Sciarra | 381/329 |
| 5,396,563 | A * | 3/1995 | Yoshimi | 381/380 |
| 5,887,070 | A | 3/1999 | Iseberg et al. | |
| 6,478,656 | B1 * | 11/2002 | Khouri | 450/39 |
| 7,130,437 | B2 * | 10/2006 | Stonikas et al. | 381/322 |
| 7,227,968 | B2 * | 6/2007 | van Halteren et al. | 381/328 |
| 7,362,875 | B2 * | 4/2008 | Saxton et al. | 381/322 |
| 7,425,196 | B2 * | 9/2008 | Jorgensen et al. | 600/25 |
| 7,778,434 | B2 * | 8/2010 | Juneau et al. | 381/328 |
| 2002/0025055 | A1 * | 2/2002 | Stonikas et al. | 381/322 |
| 2002/0122563 | A1 * | 9/2002 | Schumaier | 381/326 |
| 2002/0129819 | A1 * | 9/2002 | Feldman et al. | 128/831 |
| 2002/0196958 | A1 * | 12/2002 | Halteren et al. | 381/328 |
| 2004/0215053 | A1 * | 10/2004 | Jorgensen et al. | 600/25 |
| 2004/0258263 | A1 * | 12/2004 | Saxton et al. | 381/328 |
| 2006/0098833 | A1 * | 5/2006 | Juneau et al. | 381/328 |
| 2006/0165249 | A1 | 7/2006 | Sato | |
| 2007/0000499 | A1 | 1/2007 | Buck et al. | |
| 2007/0116319 | A1 * | 5/2007 | Hagberg | 381/380 |
| 2007/0121980 | A1 * | 5/2007 | Menzl | 381/328 |
| 2007/0183613 | A1 * | 8/2007 | Juneau et al. | 381/322 |
| 2008/0137892 | A1 * | 6/2008 | Shennib et al. | 381/328 |
| 2008/0299339 | A1 * | 12/2008 | Keady | 428/35.7 |
| 2009/0022353 | A1 * | 1/2009 | Goldstein et al. | 381/380 |

(Continued)

FOREIGN PATENT DOCUMENTS

EP 0517497 6/1992

(Continued)

OTHER PUBLICATIONS

U.S. Appl. No. 60/916,275, filed May 4, 2007.

(Continued)

*Primary Examiner* — David S. Warren
(74) *Attorney, Agent, or Firm* — Renner, Otto, Boisselle & Sklar, LLP

(57) ABSTRACT

The present invention provides an earphone comprising an electro-active polymer that is adapted such that the outer circumference of a resilient member of the earphone is responsive to an electric voltage, enabling providing essentially sealing the ear canal when the resilient member of the earphone at least partly is inserted in an ear canal of a wearer. The electro-active polymer also enables an improved game and sound experience by providing by synchronizing the outer circumference of the resilient member with the electric signal provided to the earphone.

13 Claims, 3 Drawing Sheets

U.S. PATENT DOCUMENTS

| | | | | |
|---|---|---|---|---|
| 2009/0155518 | A1* | 6/2009 | Keady | 428/66.4 |
| 2009/0214072 | A1* | 8/2009 | Staab et al. | 381/380 |
| 2009/0238374 | A1* | 9/2009 | Keady | 381/72 |
| 2009/0238386 | A1* | 9/2009 | Usher et al. | 381/315 |
| 2009/0240497 | A1* | 9/2009 | Usher et al. | 704/235 |
| 2010/0002897 | A1* | 1/2010 | Keady | 381/328 |
| 2010/0012420 | A1* | 1/2010 | Keady | 181/135 |
| 2010/0014696 | A1* | 1/2010 | Boschung et al. | 381/328 |

FOREIGN PATENT DOCUMENTS

| | | | |
|---|---|---|---|
| EP | 1 653 776 | A2 | 5/2006 |
| EP | 1 653 776 | A3 | 7/2006 |

OTHER PUBLICATIONS

International Search Report corresponding to PCT/EP2008/054873, mailed Sep. 4, 2008.

* cited by examiner

EARPHONE AND A METHOD FOR PROVIDING AN IMPROVED SOUND EXPERIENCE

TECHNICAL FIELD

The present invention relates in general to earphones and in particular to insert earphones capable to seal the ear canal when inserted.

BACKGROUND

Earphones have become very popular as more and more people wear portable electronic devices, such as mp3-players and mobile phones.

There are a variety of sizes of the earphones, of which a few a large and encompass the entire outer ear when worn by a user, whereas others are small and are designed to be inserted into the ear canal of the user.

From EP 0517497 it is known an earphone designed like an earplug to be inserted into the ear canal. This earplug is further adapted to shut the auditory meatus of an ear in use, so as to acoustically isolate the external auditory meatus from the outside of the ear.

From U.S. Pat. No. 5,887,070 a high fidelity insert earphone and methods of making same are known. This earphone is provided with a damper and receiver are mounted such that the damper and receiver response compensates for loss of external ear resonance and coupling resonance that otherwise would occur when the insert earphone is inserted into the ear canal.

US 2006/0165249 A1 teaches a small earphone or headphone that can produce a wide band acoustic output from a low-pitched tone to a high-pitched tone and can generate a body-sensitive vibration independent output or a body-sensitive vibration output synchronized with music.

Electro active polymers (EAP) are characterised by their ability to change shape in response to electrical stimulation. The electro-active polymers may be categorised in two major groups, one being electrostatic EAPs, and the other being ionic EAPs. The electro static EAPs as today typically require a voltage of the order of kilo Volts to generate a substantial shape change, the ionic EAPs currently available show shape changes as a response to voltages of the order of Volts.

An electro-active polymer (EAP) device 100, 120 according to the prior is illustrated in FIGS. 1A and 1B. In FIG. 1A the EAP device 100 comprises an upper electrode 102, a lower electrode 104 and an EAP portion 106. The upper and lower electrodes 102, 104 are arranged opposite in relation to one another, surrounding the EAP portion 106.

In FIG. 1B an electro-active polymer device 120 is shown onto which an electric voltage 128 has been applied between an upper electrode 122 and a lower electrode 124, wherein the lower electrode is connected to ground potential. The two electrodes 122 and 124 surround the EAP portion 126, providing an electric field across the EAP causes a shape change of the EAP. The EAP device 120 typically shrinks in the direction of the electric field lines between the two electrodes 122 and 124, whereas the EAP device 120 typically expands in a direction perpendicular to these field lines. The EAP device 120 may thus expand in a direction parallel with the electrodes 122 and 124, as a consequence of the applied electric potential V, 128.

Albeit the large number of earphones disclosed, there is still a need for improving the sound provision to the wearers of the earphones.

SUMMARY

An object of the present invention is to provide an improved sound experience to a user wearing the earphone.

According to an aspect of the present invention, there is provided an earphone comprising a resilient member being adapted to at least partly be inserted in an ear canal, and an electro active polymer adapted such that the outer circumference of the resilient member is responsive to an electric voltage when being applied to the electro active polymer, so that the resilient member can substantially seal the ear canal when inserted.

According to another aspect of the present invention, there is provided a method for providing an electric voltage to an earphone comprising the steps of receiving a first electric signal having an essentially constant voltage component, and applying said first electric signal to an electro-active polymer of an earphone, said electro active polymer being adapted such that the outer circumference of a resilient member is responsive to the first electric signal, causing the resilient member to substantially seal an ear canal of a wearer when the resilient member at least partly is inserted in the ear canal.

It should be emphasized that the term "comprises/comprising" when being used in the specification is taken to specify the presence of the stated features, integers, steps or components but does not preclude the presence or addition of one or more other features, integers, steps or components or groups thereof.

BRIEF DESCRIPTION OF THE DRAWINGS

In order to explain the invention and the advantages and features thereof in more detail, embodiments will be described below, references being made to the accompanying drawings, in which.

DETAILED DESCRIPTION

Figure 1A:
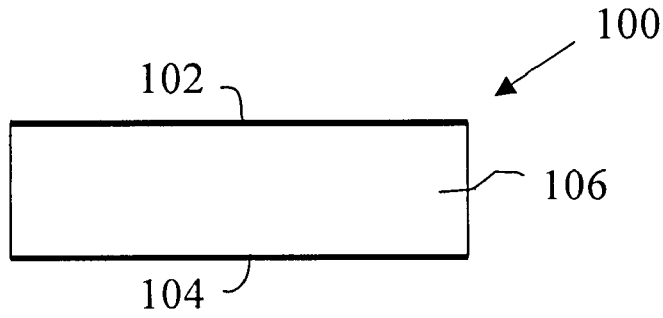
FIG. 1A PRIOR ART
FIGS. 1A and 1B are schematic representations of an electro-active polymer according to prior art.
Figure 1B:
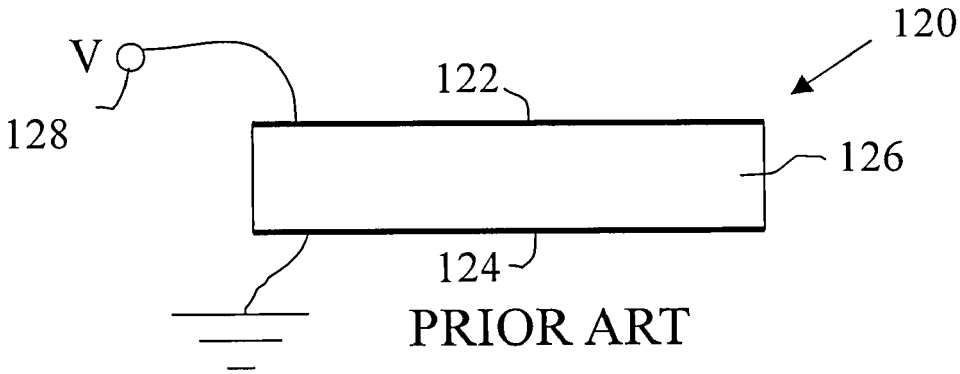
FIG. 1B PRIOR ART
Figure 2:
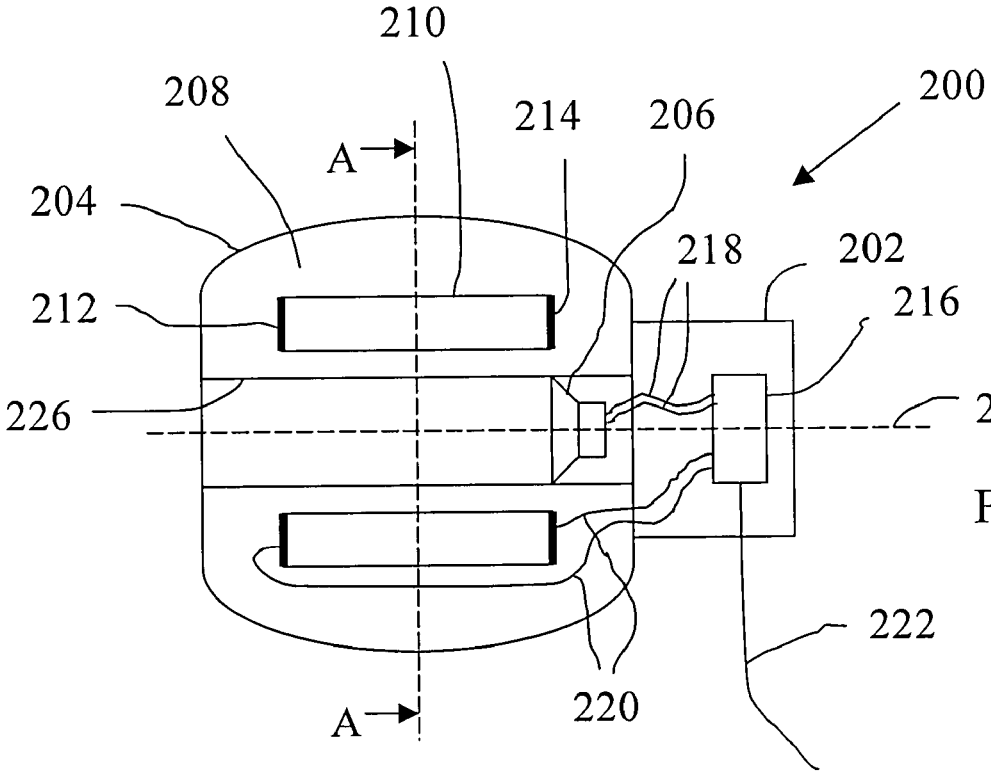
FIG. 2 is a schematic presentation of a lateral view of an earphone illustrating some embodiments.

With reference to FIG. 2 some embodiments of an earphone 200 will now be described.

According to some embodiments the earphone 200 comprises a first section 202 and a second section 204, where the first section 202 or the second section 204 may comprise an electro-acoustic transducer 206 for transducing electric energy to acoustic energy. In FIG. 2 the electro-acoustic transducer 206 is comprised in the second section. This transducer 206 may be connected to a signal processing unit 216 of the first section via connections 218. The signal processing unit 216 may be fed with an input electric signal via cable 222.

The second section 204 may comprise a resilient member 208, which further may comprise an electro-active polymer 210 according to some embodiments. The electro active polymer 210 may be flanked by a first 212 and a second 214 electrode, where the first 212 and second 214 electrodes may be oriented opposite in relation to one another. These electrodes may further be connected to the signal processing unit 216 of the first section 202, by wires 220, according to some embodiments.

A symmetry axis is indicated by the broken line 224, indicating that the first and second section may be essentially circular symmetric, disregarding the connections 218 and 220.

The connections 218 between the electro-acoustic transducer 206 and the signal processing unit 216 and the connections 220 between the electrodes 212 and 214 of the electro-active polymer and the signal processing unit 216, are typically not symmetrical with respect to the indicated symmetry axis 224.

Electric energy may hence be fed to the signal processing unit 216 in the form of the input electric signal, after which a first electric signal may be delivered to the electrodes 212 and 214 flanking the electro active polymer 210, and a second electric signal may be delivered to the electro-acoustic transducer 206.

In FIG. 2, it is further shown that the inner circumference 226 of the resilient member 208 of the second unit 204, forms a canal for transportation of acoustic energy from the electro-acoustic transducer. When a wearer is wearing the earphone this acoustic energy may be transported towards an eardrum of the wearer when the resilient member 208 of the earphone 200 at least partly is inserted in the ear canal of the wearer.

In addition, the electro acoustic transducer may be located partly or wholly located within the canal formed by the inner circumference 226, or alternatively be located outside the canal with the electro-acoustic transducer being located co-axially with the symmetry axis of the canal and directed for transporting acoustic energy through the canal.

The inner circumference 226 forming the canal, through which sound may be transported to a wearer's eardrum, and wherein the electro-acoustic transducer may be located, may moreover according to some embodiments be comprised of a member different from the resilient member (not shown).

Figure 3:
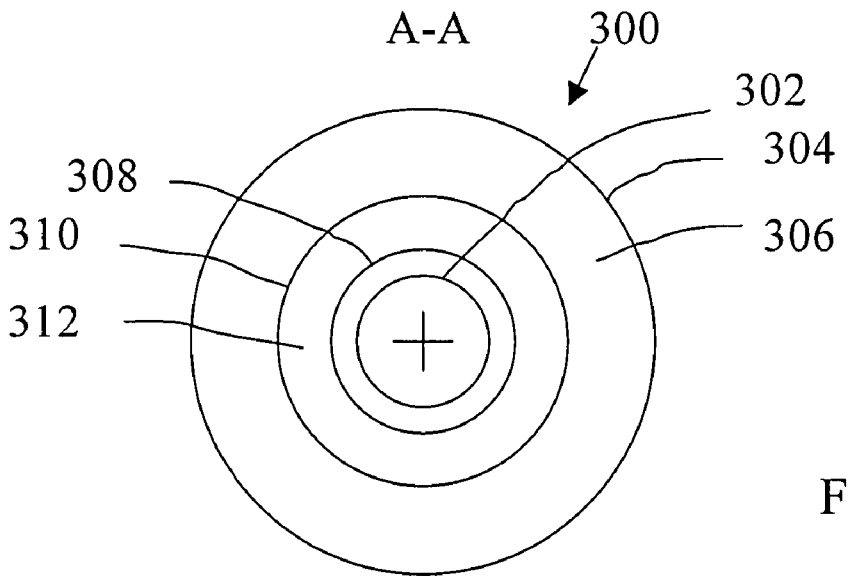
FIG. 3 is a schematic presentation of a longitudinal view of an earphone illustrating some embodiments.

By referring to FIG. 3 being an illustration of some embodiments of an earphone 300, a relative orientation of an electro-active polymer 312 and a resilient member 306, both comprised in the earphone 200, is shown.

From FIG. 3 showing a longitudinal view of the earphone 200 of FIG. 2, it is shown that the electro active polymer 312 may be tubular according to some embodiments. The resilient member 306 may also be tubular defining an inner circumference 302, which may form a canal for transportation of acoustic energy from an electro-acoustic transducer to a wearer's ear.

From FIG. 3 it can also be seen that the resilient member 306 and the electro-active polymer 312 may be oriented co-axially in relation to one another. The circumferences 308 and 310 of the electro-active polymer may define the inner and outer borders of the electro active polymer 312 relative to the symmetry axis as indicated in FIG. 3 and as shown in FIG. 2 by the numeral 224.

Figure 4:
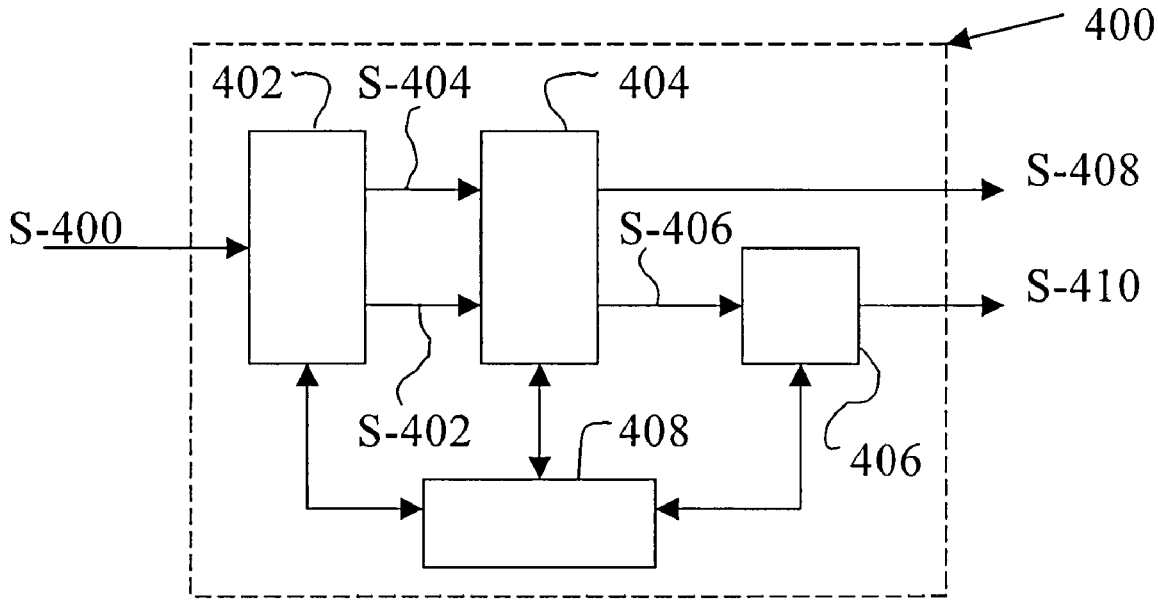
FIG. 4 is a block diagram of a signal processing unit of an earphone illustrating some embodiments.

FIG. 4 presents a block diagram 400 of a signal processing unit 216 of the earphone 200 according to some embodiments. The block diagram according to these embodiments comprises a signal extracting unit 402 adapted to form a first electric signal S-402 and a second electric signal S-404 from the input electric signal S-400, a synchronizing unit 404 adapted to synchronize the first electric signal S-402 and the second electric signal S-404, an amplifying unit 406 being adapted to amplify the synchronized first electric signal S-406 to provide the amplified synchronized first electric signal S-410. The signal processing unit 400 may also comprise a control unit 408 that controls the steps of the extracting unit 402, the synchronizing unit 404 and the amplifying unit 406.

The first electric signal 4-302 may comprise an essentially constant voltage component and may also comprise an essentially varying voltage component corresponding to high energy signal passages as comprised within the input electric signal S-400.

Accordingly, the signal extracting unit 402, may be arranged to extract high energy signal passages of the input electric signal S-400. The high energy signal passages may comprise rhythm information that typically comprise low frequencies audible to humans, typically the base contents of the input electric signal S-400. The signal extracting unit 402 may comprise a beat extractor or a beat detector arranged to extract or detect, respectively, the beat of the input electric signal S-400.

Whereas the essentially constant electric voltage component of the first electric signal may comprise a static voltage, the essentially varying electric voltage component typically comprise a voltage being modulated by the content of the electric signal S-400.

The passages having a relatively high energy as mentioned above may typically correspond to the musical beat or rhythm of the sound, but may also corresponds to sound transients or sound of explosions or the like.

The second electric signal S-404 may be essentially the same signal as the input electric signal S-400, with the exception that S-404 may have been subjected to a short delay relative to the input signal S-400.

Since the first and second electric signals have been processed by the signal extracting unit 402, they may have been subjected to different delays in relation to one another. For this reason these signals S-402 and S-404 are subjected to a synchronizing unit 404, which is adapted to synchronize the first electric signal S-402 and the second electric signal S-404, forming synchronized first electric signal S-406 and synchronized second electric signal S-408.

The synchronized first electric signal S-406 may moreover be provided to an amplifying circuit 406 for amplification of the synchronized first electric signal S-406. The amplifying circuit 306 is thus adapted to provide an amplified signal S-410 that is fully or at least essentially synchronized with the synchronized second electric signal S-408, to the electrodes 212 and 214 of the electro-active polymer 210, such that the electro-active polymer can respond to the applied signal S-410.

When applying the electric signal S-410 to the earphone 200,300 the earphone responses according to the content of the electric signal S-410. An essentially constant electric voltage component of the electric signal S-410, would provide an essentially static shape change of the EAP. In case the EAP is oriented in the earphone as indicated in FIG. 2 and 3, the outer circumference of the EAP could increase as a response to an applied electric voltage, and as a consequence also the outer circumference of the resilient member 208, 306, providing a physical pressure onto the inner circumference of a wearers ear canal, when the earphone is inserted in said ear canal.

The essentially varying electric voltage component of the electric signal S-410, could provide a dynamic shape change of the EAP, when feeding the signal S-410 to an earphone comprising an EAP, such as indicated in FIGS. 2 and 3. High energy passages could for instance generate increases in the outer circumference of the resilient member 208, 306 providing a dynamic pressure to the inner circumference of a wearer's ear canal, when the earphone is inserted in said ear canal, causing a sensation to the wearer.

The second electric signal S-408 however is typically provided to the electro-acoustic transducer 206 of the earphone 200, for transducing electric energy to acoustic energy, to be directed into an ear canal of a wearer.

Figure 5:
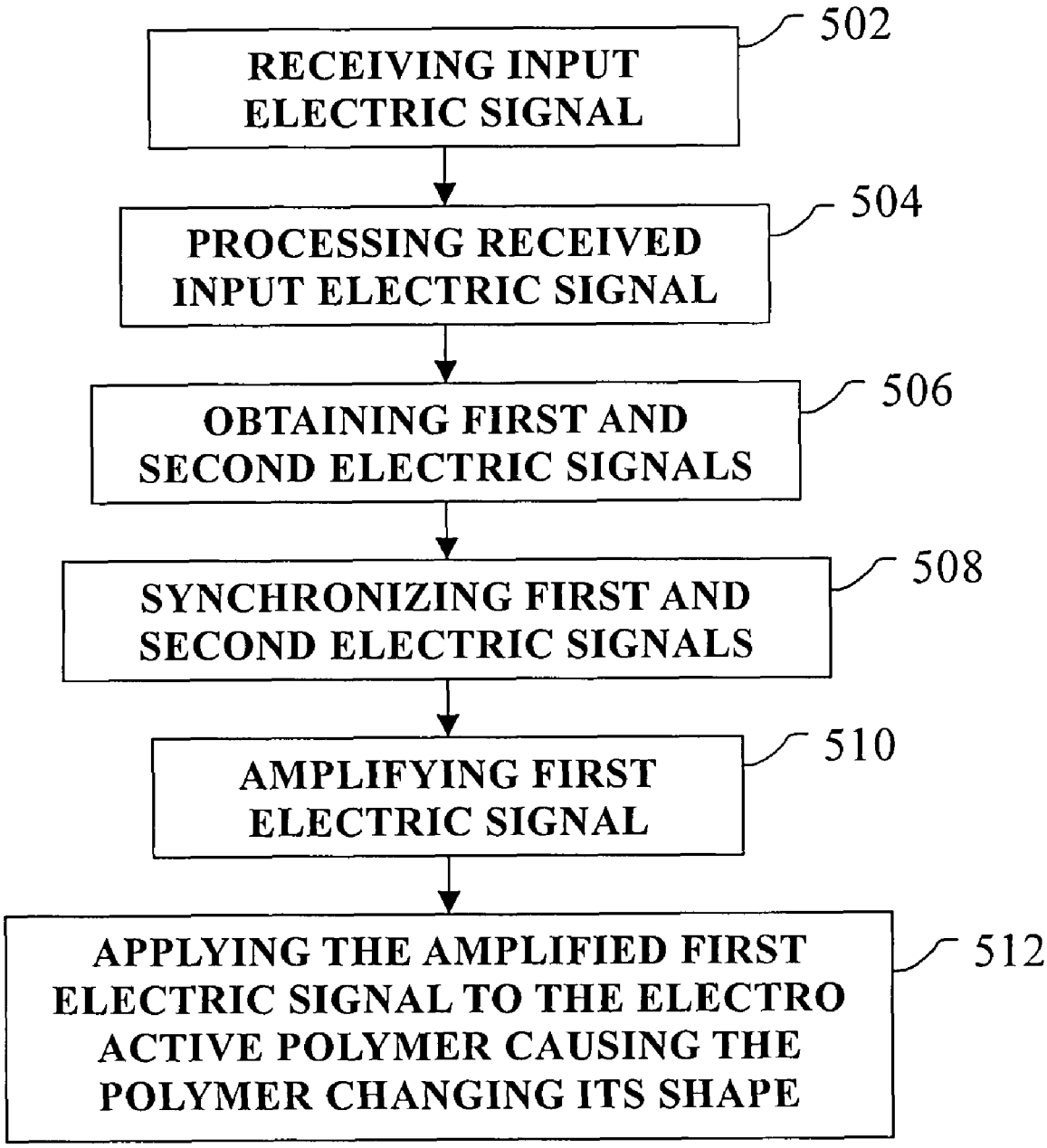
FIG. 5 is a flowchart illustrating some embodiments.

FIG. 5 illustrates method steps according to some embodiments. This method may start by receiving an input electric signal S-400, step 502. This step may be performed by the signal extracting unit 402. The subsequent step, step 504 may be the step of processing received input electric signal S-400. This step may also be carried out by the signal extracting unit 404.

Upon processing the input electric signal S-400, a first S-402 and a second S-404 electric signal may be obtained, step 506 by the signal extracting unit 402, as described above.

These first S-402 and second S-404 electric signals, which may be out of sync, may be provided to a synchronizing unit 404, wherein the first electric signal and the second electric signal may be synchronized with each other.

Having obtained synchronized first electric signal S-406 and synchronized second electric signal S-408, the first synchronized electric signal S-406 may be amplified in step 510, forming an amplified essentially synchronized first electric signal S-410.

According to some embodiments, the method stops by the step of providing said amplified synchronized first electric signal S-410 to the electro active polymer 210, enabling the polymer to change its shape.

According to some embodiments, and in dependence of the content of the synchronized first electric signal S-410, the electro-active polymer may respond by changing its shape with a relatively high frequency such that a wearer of an earphone comprising such an EAP would experience a vibration or even a audible signal in the ear having the earphone.

It is emphasized that the present embodiments can be varied in many ways, of which the alternative embodiments as presented are just a few examples. These different embodiments are hence non-limiting examples. The scope of the present invention, however, is only limited by the subsequently following claims.

According to some embodiments the synchronizing unit 404 may perform synchronization of the first electric signal S-402 and the second electric signal S-404, such that the amplified electric signal S-410 is synchronized with the second electric signal S-408. Alternatively, the synchronization by the synchronization unit 404 is performed such that the second electric signal S-408 is synchronized with the amplified first electric signal S-410. Either one of the first and second electric signals or both the first and second electric signals, may thus be subject to a delay to achieve synchronization.

According to some embodiments, the amplifying unit 406 may be connected such that it amplifies the second electric signal S-408 to be delivered to the electro-acoustic transducer 206, to provide a satisfactory sound experience to the wearer wearing the earphone 200, 300.

According to yet some embodiments, the EAP used in the EAP device 200, 300 may have the ability to change its volume as a response to an applied electric field.

According to still some embodiments, the first section may be located within the second section.

According to some embodiments, the resilient member 208, 306 and the electro active polymer 210, 312 may be comprised of a unitary member.

According to still some embodiments, the ear phone 200, 300 may comprise an electro-active polymer that in itself is resilient, such that an additional resilient member 208, 306 as illustrated in FIGS. 2 and 3, may not be required to achieve a comfortable earphone for a wearer. In such an embodiment the EAP, preferably coated for hygienic reasons, would come in close contact with the inner circumference of an ear canal when being inserted in the ear canal of a wearer.

According to some embodiments, an earphone may be provided with one or more EAPs having electrodes provided on the outer and the inner co-axially oriented envelope surfaces. Upon application of an electric voltage such as the amplified first electric voltage S-410 onto such electrodes, the outer circumference of the EAP and therefore also the resilient member 208, 306, would increase, providing a pressure on the inner circumference of a wearer's ear canal, when the earphone is inserted in the ear canal.

According to some embodiments, the earphone may comprise a communication unit for example located within the signal processing unit 216, 400 for wirelessly communicating the input electric signal to the earphone 200.

According to some embodiments the synchronized first electric signal S-406 may be provided directly to the electrodes 212 and 214, of the electro-active polymer 210, without being amplified by the amplifying circuit 406 of the signal processing unit 400.

It is thus easy to understand that the embodiments comes with a number of advantages of which one is providing essentially sealing the ear canal when the earphone is inserted therein.

Another advantageous feature at least of some embodiments is that an improved sound and gaming experience may be provided by an earphone comprising a resilient member having an outer circumference being responsive to the input electric signal provided to the earphone 200, 300. By providing the electric signal to the earphone 200, 300 comprising an EAP, a dynamic pressure, being synchronized with the content of the electric signal, may thus be provided to an ear canal of a wearer, causing a sensation to the wearer wearing the earphone.

The invention claimed is:

1. An earphone comprising:

a resilient member being adapted to at least partly be inserted in an ear canal, and an electro active polymer adapted such that the outer circumference of the resilient member is responsive to an electric voltage when being applied to the electro active polymer, so that the resilient member can substantially seal the ear canal when inserted.

2. The earphone according to claim 1, wherein the earphone further comprises a signal processing unit adapted to provide a first electric signal having an essentially constant voltage component to be applied to the electro-active polymer.

3. The earphone according to claim 1, wherein the earphone further comprises a signal processing unit adapted to provide a first electric signal having an essentially varying voltage component to be applied to the electro active polymer, upon connection of an input signal to the signal processing unit.

4. The earphone according to claim 1, wherein the earphone further comprises an electro-acoustic transducer adapted to transduce a second electric signal to be supplied to the transducer, into acoustic energy.

5. The earphone according to claim 2, wherein the signal processing unit further comprises a synchronizing unit that is adapted to synchronize the essentially varying voltage component of the first electric signal, and a second electric signal to be supplied to the transducer.

6. The earphone according to claim 1, wherein the resilient member and the electro-active polymer are tubular and co-axially oriented in relation to one another.

7. The earphone according to claim 1, wherein the electro-active polymer may comprise an ionic electro-active polymer.

8. Method for providing an electric voltage to an earphone comprising the steps of:

receiving a first electric signal having an essentially constant voltage component, and applying said first electric signal to an electro-active polymer of an earphone, said electro active polymer being adapted such that the outer circumference of a resilient member of the earphone is responsive to the first electric signal, causing the resilient member to substantially seal an ear canal of a wearer when the resilient member at least partly is inserted in the ear canal.

9. The method according to claim 8, wherein the step of receiving comprises receiving the first electric signal having an essentially varying voltage component, enabling the outer circumference of the resilient member to vary.

10. The method according to claim 8, further comprising receiving an input electric signal enabling provision of a second electric signal to an electro-acoustic transducer.

11. The method according to claim 10, further comprising a step of processing the input electric signal, forming the first and second electric signals.

12. The method according to claim 10, further comprising a step of synchronizing the essentially varying voltage component of the first electric signal, and the second electric signal.

13. The method according to claim 12, comprising providing the essentially varying voltage component of the synchronized first electric signal to the electro-active polymer, and the synchronized second electric signal to the electro-acoustic transducer, such that a physical pressure can be provided to a wearer's ear canal when wearing the earphone, where the pressure is essentially synchronized with the synchronized second electric signal.

* * * * *